United States Patent [19]

Tervola

[11] Patent Number: 4,905,335

[45] Date of Patent: Mar. 6, 1990

[54] MAGNETIC RINGS, BRACELETS AND NECKLACES

[76] Inventor: Pentti J. Tervola, 3663 Lakewood Rd., Lake Worth, Fla. 33461

[21] Appl. No.: 249,770

[22] Filed: Sep. 26, 1988

[51] Int. Cl.[4] ..... B25F 1/00

[52] U.S. Cl. ..... 7/169; 7/170; 7/165; 7/901; 7/151; 81/3.09; 30/298; 294/25; 294/65.5

[58] Field of Search ..... 7/121, 165, 170, 169, 7/901, 151; 81/3.09, 3.55, 3.07, 436, 439; 30/298, 232, DIG. 8; 294/25, 65.5

[56] References Cited

U.S. PATENT DOCUMENTS

| | | | |
|---|---|---|---|
| 2,176,052 | 10/1939 | Beyer | 294/65.5 |
| 2,585,641 | 2/1952 | Faso | 294/25 |
| 2,735,321 | 2/1956 | Browne et al. | 81/436 |
| 4,174,620 | 11/1979 | Russell | 294/25 |
| 4,332,178 | 6/1982 | Vukich | 81/436 |
| 4,667,544 | 5/1987 | Milo | 7/151 |

FOREIGN PATENT DOCUMENTS

| | | | |
|---|---|---|---|
| 33541 | 8/1924 | Denmark | 30/298 |
| 178741 | 3/1962 | Sweden | 294/25 |
| 1237408 | 6/1986 | U.S.S.R. | 81/436 |

*Primary Examiner*—Roscoe V. Parker
*Attorney, Agent, or Firm*—Alvin S. Blum

[57] ABSTRACT

A device in the form of a ring for wearing on a finger, a bracelet for wearing on a wrist or a necklace for wearing on the neck bears a magnetic pick-up for engaging ferromagnetic objects. It may include other tools such as screwdriver blades, line cutters, prying claws and the like for convenience in having certain useful tools at hand when needed without encumbering the hands of the user.

20 Claims, 2 Drawing Sheets

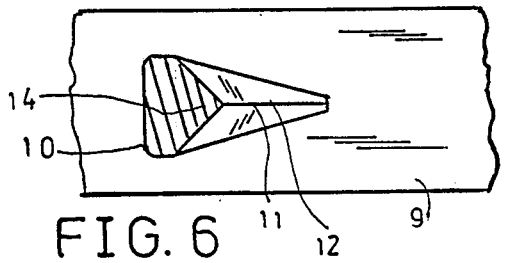
FIG. 6
FIG. 5
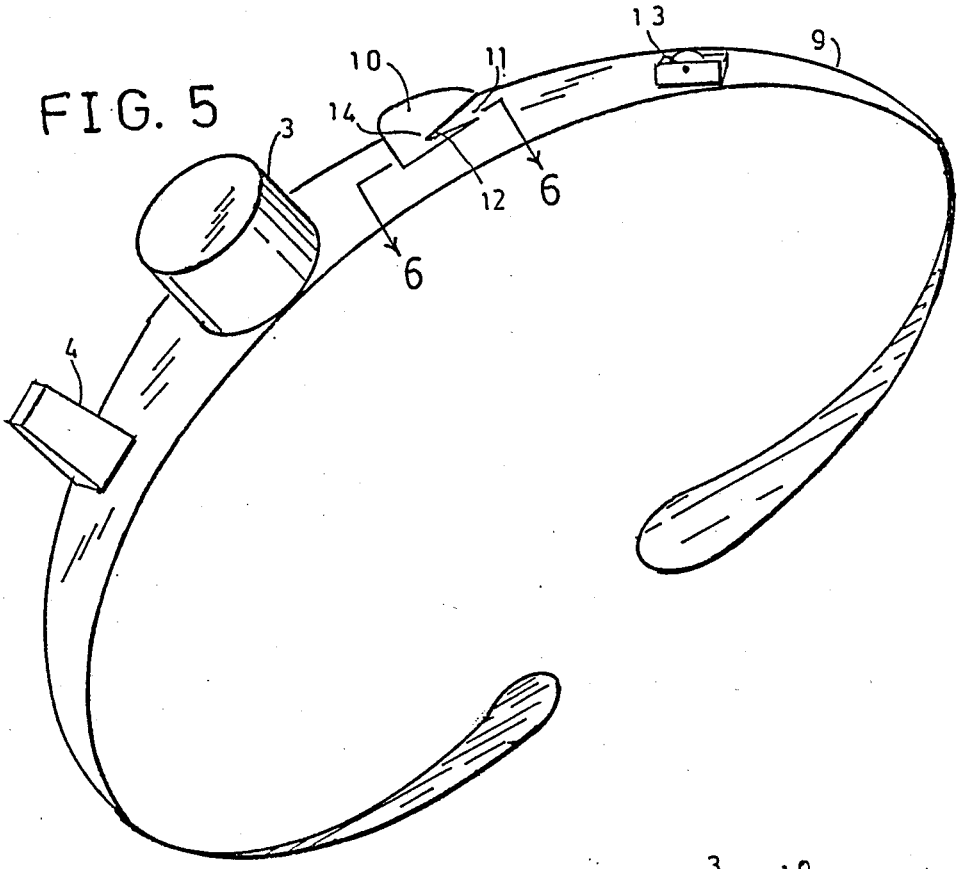
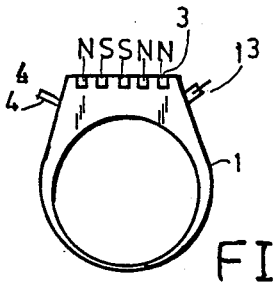
FIG. 7
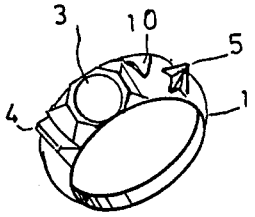
FIG. 8

MAGNETIC RINGS, BRACELETS AND NECKLACES

This invention relates to rings, bracelets and necklaces, and more particularly to such devices that incorporate a magnetic element for engaging ferromagnetic materials and other useful tools such as screw driver elements, line cutters and the like.

BACKGROUND OF THE INVENTION

It is very useful for a worker to have rapid and convenient access to a magnet for picking up small objects, removing metal splinters, identifying metals, holding papers against a metal object and the like. However most workers will not bother to carry a magnet about because it is so infrequently used. Because it is not at hand when needed, they lose the many advantages of a magnet. The same may be said of other tools that are not very large, but would be inconvenient to carry about, such as screwdrivers and line cutters. Many individuals find it less objectionable to wear an article of adornment such as a ring, bracelet or necklace, because the hands are left free.

SUMMARY OF THE INVENTION

It is accordingly an object of the invention to provide an article worn by the user, including a ring, a bracelet, or a necklace that incorporates a magnet means for use in engaging ferromagnetic materials.

It is a further object of the invention to provide such a body part encircling band in combination with one or more screwdriver bits constructed for direct use without the need for additional members such as handles.

It is yet another object to provide such a band in combination with a hook that may serve as a line cutter, bottle and can opener, or ripping claw.

It is yet another object to provide a body part encircling band with cutters, openers or claws and the like made in one piece without moving parts.

Screwdrivers, line cutters and the like may be formed in one piece with said band such as by casting, or may be attached by conventional means.

It is yet another object to provide such a band in combination with on or more of the following accessories: screwdriver bits; magnet means; line cutter; container opener; claw; glass cutter.

It is yet another object to provide such a band with a series of magnets arranged in coded order for unlocking a magnetic lock.

BRIEF DESCRIPTION OF THE DRAWINGS

FIG. 5 is a perspective view of a bracelet or necklace combining magnet, line cutter and screwdriver.

FIG. 6 is a cross section through 6—6 of FIG. 5.

FIG. 7 is a front elevation of a ring with magnetic key, glass cutter and screwdriver.

FIG. 8 is a perspective view of a ring including magnet, hook-line cutter and screwdrivers.

DETAILED DESCRIPTION OF PREFERRED EMBODIMENTS

Figure 1:
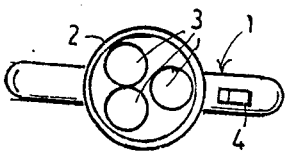
FIG. 1 is a plan view of a ring of the invention with a plurality of magnets in the center and a straight blade screwdriver on one side.
Figure 2:
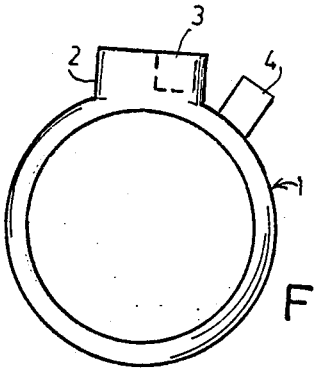
FIG. 2 is a front elevation view of the ring of FIG. 1.

Referring now first to FIGS. 1 and 2, a non-magnetic stainless steel ring 1 has a cylindrical member 2 holding three short cylindrical magnets 3 one of which is shown in phantom in FIG. 2. On one side of the ring, a screwdriver blade 4 for a slottd screw is mounted for convenient use as a screwdriver or a prying tool with the ring serving as a handle. The screwdriver function can be operated with the ring on the finger or holding the ring between the fingers as needed.

Figure 3:
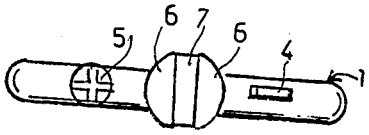
FIG. 3 is a plan view of a ring formed of a magnetic material bent into a ring shape with Phillips head and straight screwdrive members.
Figure 4:
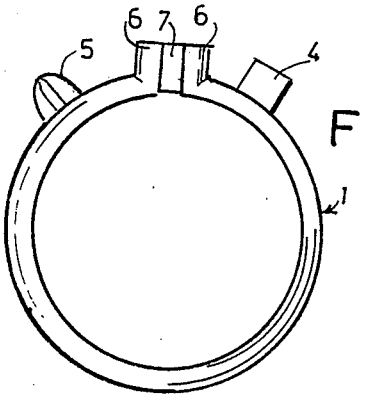
FIG. 4 is a front elevation view of the ring of FIG. 3.

The finger ring of FIGS. 3 and 4 has both a straight screwdriver blade 4 and a cross slot or Phillips head screwdriver blade 5 mounted on either side of a magnetic head 6. The ring is formed from an elongate bar of magnetic material with a half-round cross section bent into a ring shape with the ends 6 bent up to form what is in effect a horseshoe magnet with a gap 7 that may be filled with docorative material. When this shape is magnetized, it has great magnetic strength at the radially turned-up ends.

FIG. 5 shows a bracelet 9 for wearing on a wrist or necklace for wearing around the neck on which is mounted a cylindrical magnet 3, a straight screwdriver blade 4 and a hook or claw 10 with a tapered gap 11 that may be used as a claw or hook for lifting tabs, bottle caps, and the like. The gap 11 may be provided with a sharpened inner region 12 for cutting whatever is fitted into the gap 11 such as cans, fishing line, twine or thread. A ring may also be provided with a similar device that may be positioned wherever it will function most effectively. For example, the claw may be located to fit between the fingers to prevent inadvertent snagging of objects. A cutter 13 for cutting glass, paper and the like may also be attached to ring 1.

The band may be made of separate parts hinged together or a chain configuration for a flexible fit around neck or wrist as desired and accessory tools may be positioned and constructed so as to prevent inadvertent snagging of objects.

As illustrated in FIG. 5 and the cross sectional detail of FIG. 6, the hook or claw 10 is made in one piece without moving parts, with a narrow body 14 tapering to a sharp edge at the gap 12. This structure has been found to be especially effective for cutting cord, thread, fishing line and the like by forming a loop in the cord and pulling the bight of the loop into gap 12 against the sharpened edges. As shown in FIG. 6, the body 14 forms what is effectively a knife edge at the apex of the sharp Y-shaped gap.

The encircling band for encircling a body part such as a finger, a wrist or a neck may take the form of a continuous band such as shown in FIGS. 1 or 2 or a discontinuous band such as shown in FIGS. 3–5 which may have sufficient spring action that they may fit body parts of different sizes.

The band may be made of separate parts hinged together or a chain configuration for a flexible fit around neck or wrist as desired and accessory tools may be positioned and constructed so as to prevent inadvertent snagging of objects.

There are numerous locks well known in the art that can only be opened by application of a magnetic key comprised of a plurality of small magnets arranged in a particular distribution and polarity that constitutes a code for unlocking a particular lock. FIG. 7 shows aring 1 bearing such a key in the form of a plurality of magnets 3 having indicated polarities N for north and S for south at their uppermost ends. A thin cover may conceal the magnets if desired. The ring further includes screwdriver 4 and glass cutter 13. This is especially handy for a motor vehicle lock since it is not easily misplaced and the glass cutter can aid in escaping when trapped within the vehicle.

FIG. 8 shows a ring 1 including a magnet 3, screwdriver bits 5 and 4 and a claw hook including a line cutter 10. Construction materials may include various metals, plastics, precious stones and the like for enhanced function and appearance.

The manner of construction of these devices is well known in the jewelry and metal working art and may take the many alternative forms that these devices have been known to take for an attractive and comfortable accessory that will serve useful as well as decorative functions.

The above disclosed invention has a number of particular features which should preferably be employed in combination although each is useful separately without departure from the scope of the invention. While I have shown and described the preferred embodiments of my invention, it will be understood that the invention may be embodied otherwise than an herein specifically illustrated or described, and that certain changes in the form and arrangement of parts and the specific manner of practicing the invention may be made within the underlying idea or principles of the invention within the scope of the appended claims.

I claim:

1. A body-part-encircling band to be worn on the body part, said body part selected from the group consisting of finger, arm and neck, said band constructed from an elongate piece of magnetic material bent into a band shape with the ends turned up substantially radially for engaging ferromagnetic materials at said ends.

2. The band according to claim 1, including at least one screwdriver means for engaging the head of a screw, said screwdriver means securely connected to said band to provide for turning said screw by turning said band.

3. The band according to claim 1, further including one-piece cord cutter means for cutting cord, thread, or line, said cutter means securely connected to said band and having a tapered slot with at least one sharp internal edge tapering to a knife edge at said slot.

4. The band according to claim 2, further including one-piece cord cutter means for cutting cord, thread, or line, said cutter means securely connected to said band and having a tapered slot with at least one sharp internal edge tapering to a knife edge at said slot.

5. The band according to claim 1, further including a glass cutter securely connected to said band.

6. The band according to claim 2, further including a glass cutter securely connected to said band.

7. The band according to claim 3, further including a glass cutter securely connected to said band.

8. The band according to claim 1, further including a one-piece container opener securely connected to said band.

9. The band according to claim 2, further including a one-piece container opener securely connected to said band.

10. The band according to claim 3, further including a one-piece container opener securely connected to said band.

11. The band according to claim 4, further including a one-piece container opener securely connected to said band.

12. The band according to claim 5, further including a one-piece container opener securely connected to said band.

13. The band according to claim 6, further including a one-piece container opener securely connected to said band.

14. The band according to claim 7, further including a one-piece container opener securely connected to said band.

15. The band according to claim 4, further including a glass cutter securely attached to said band.

16. The band according to claim 15, further including a one-piece container opener securely connected to said band.

17. A body-part-encircling band to be worn on a body part, said body part selected from the group consisting of finger, arm and neck, said band including:

(a) at least one screwdriver means for engaging the head of a screw, said screwdriver means securely connected to said band to provide for turning said screw by turning said band;

(b) magnet means securely connected to said band for magnetically engaging ferromagnetic materials; and (c) a plurality of individual magnets arranged on said band in a coded sequence and polarity for functioning as a magnet key for unlocking a magnetically actuated lock.

18. A body-part-encircling band to be worn on a body part, said body part selected from the group consisting of finger, arm and neck, said band including:

(a) at least one screwdriver means for engaging the head of a screw, said screwdriver means securely connected to said band to provide for turning said screw by turning said band;

(b) one-piece cord cutter means for cutting cord, thread or line, said cutter means securely connected to said band and having a tapered slot with at least one sharp internal edge tapering to a knife edge at said slot; and (c) a plurality of individual mangets on said band in a coded sequence and polarity for functioning as a magnetic key for unlocking a magnetically actuated lock.

19. A body-part-encircling band to be worn on a body part, said body part selected from the group consisting of finger, arm and neck, said band including:

(a) at least one screwdriver means for engaging the head of a screw, said screwdriver means securely connected to said band to provide for turning said screw by turning said band;

(b) a glass cutter securely connected to said band; and (c) a plurality of individual magnets arranged on said band in a coded sequence and polarity for functioning as a magnet key for unlocking a magnetically actuated lock.

20. A body-part-encircling band to be worn on a body part, said body part selected from the group consisting of finger, arm and neck, said band including:

(a) at least one screwdriver means for engaging the head of a screw, said screwdriver means securely connected to said band to provide for turning said screw by turning said band;

(b) a one-piece container opener securely connected to said band; and (c) a plurality of individual magnets arranged on said band in a coded sequence and polarity for functioning as a magnet key for unlocking a magnetically actuated lock.

* * * * *